US010475305B2

(12) United States Patent
Jonsson

(10) Patent No.: US 10,475,305 B2
(45) Date of Patent: Nov. 12, 2019

(54) DETECTING POSITION OF A BARRIER

(71) Applicant: ASSA ABLOY AB, Stockholm (SE)

(72) Inventor: Tomas Jonsson, Ronninge (SE)

(73) Assignee: ASSA ABLOY AB (SE)

( * ) Notice: Subject to any disclaimer, the term of this patent is extended or adjusted under 35 U.S.C. 154(b) by 0 days.

(21) Appl. No.: 15/778,729

(22) PCT Filed: Dec. 6, 2016

(86) PCT No.: PCT/EP2016/079906

§ 371 (c)(1),
(2) Date: May 24, 2018

(87) PCT Pub. No.: WO2017/097771

PCT Pub. Date: Jun. 15, 2017

(65) Prior Publication Data

US 2018/0357867 A1 Dec. 13, 2018

(30) Foreign Application Priority Data

Dec. 10, 2015 (EP) ..... 15199150

(51) Int. Cl.

| | |
|---|---|
| ***G08B 13/08*** | (2006.01) |
| ***G08B 25/10*** | (2006.01) |
| *E05B 47/00* | (2006.01) |

(52) U.S. Cl.

CPC ..... *G08B 13/08* (2013.01); *G08B 25/10* (2013.01); *E05B 2047/0068* (2013.01)

(58) Field of Classification Search

CPC .... G08B 13/08; G08B 29/20; G08B 13/2491; G08B 25/001; G08B 25/008;

(Continued)

(56) References Cited

U.S. PATENT DOCUMENTS 6,310,549 B1 * 10/2001 Loftin ..... G08B 13/08 324/207.21
2009/0160637 A1 6/2009 Maeng (Continued)

FOREIGN PATENT DOCUMENTS

CN 101142367 3/2008
CN 103971475 8/2014

(Continued)

OTHER PUBLICATIONS

International Search Report and Written Opinion prepared by the European Patent Office dated Jan. 30, 2017, for International Application No. PCT/EP2016/079906.

(Continued)

*Primary Examiner* — Daniel Previl
(74) *Attorney, Agent, or Firm* — Sheridan Ross P.C.

(57) ABSTRACT

It is presented a method for detecting a position of a barrier. The method is performed in a status monitor device and comprising the steps of: detecting a barrier position of the barrier using a first sensor, the barrier position indicating a degree of opening of the barrier; detecting when the barrier is in a closed position using a second sensor; and calibrating the first sensor to indicate a closed position each time the barrier is detected to be in the closed position.

13 Claims, 2 Drawing Sheets

(58) Field of Classification Search
CPC .. E05B 2047/0068; E05B 39/00; E05B 47/06; G01P 15/00; G07C 2009/00769; B01L 1/00; G01N 17/004; G01N 2035/00306; E05F 15/40; E05F 15/63; E05F 15/73; E05F 15/77; E05F 15/79; E05F 2015/631; E05F 3/22; E05Y 2400/32; E05Y 2400/322; E05Y 2400/45; E06B 3/485; E06B 7/28; F25D 2323/02; F25D 23/028; F25D 2700/02; F25D 29/00; F25D 29/005; G01B 7/003; G01B 7/14; G01C 5/06; G01C 9/00; G01H 1/00; H04N 5/2252; H04N 5/2253
USPC ..... 340/545.1, 539, 547, 545.6, 545.9, 551, 340/693.9, 568.1, 571, 689
See application file for complete search history.

(56) References Cited

U.S. PATENT DOCUMENTS

2010/0288468 A1* 11/2010 Patel ..... B01D 46/10 165/59
2011/0050445 A1* 3/2011 Heeren ..... B64C 1/1415 340/686.6
2011/0257797 A1* 10/2011 Burris ..... E05F 3/102 700/282
2014/0001779 A1* 1/2014 Bedoian ..... E05B 1/003 292/336.3
2015/0348385 A1* 12/2015 Lamb ..... G08B 13/08 340/547

FOREIGN PATENT DOCUMENTS

| | | |
|---|---|---|
| CN | 204215506 | 3/2015 |
| WO | WO 2008/014593 | 2/2008 |
| WO | WO 2010/045557 | 4/2010 |

OTHER PUBLICATIONS

International Preliminary Report on Patentability for International (PCT) Patent Application No. PCT/EP2016/079906, dated Mar. 8, 2018, 7 pages.
Official Action with English Translation for China Patent Application No. 201680067356.4, dated May 23, 2019, 19 pages.

* cited by examiner

DETECTING POSITION OF A BARRIER

CROSS REFERENCE TO RELATED APPLICATIONS

This application is a national stage application under 35 U.S.C. 371 and claims the benefit of PCT Application No. PCT/EP2016/079906 having an international filing date of 6 Dec. 2016, which designated the United States, which PCT application claimed the benefit of European Patent Application No. 15199150.2 filed 10 Dec. 2015, the disclosure of each of which are incorporated herein by reference.

TECHNICAL FIELD

The invention relates to a method, status monitoring device, computer program and computer program product for detecting a position of a barrier, such as a door or a window.

BACKGROUND

It is often useful to detect the open/closed state of barriers such as doors and windows. Such information can e.g. be used for alarm systems, etc.

U.S. Pat. No. 6,310,549 B1 presents a wireless security system. Each alarm sensor contains three magnetoresistive sensors and that are capable of detecting the three-dimensional vector of a magnetic field. The sensors detect the orientation of the door or window based upon the earth's magnetic pole. The three-dimensional vector output of the magnetoresistive sensors is received by a microprocessor on-board the alarm sensor. The microprocessor continuously compares the magnetoresistive sensors output with the maximum allowable position of the door or window. In order to calibrate the alarm sensor, prior to using alarm sensor, the initial "closed" position of the door must be programmed using a reset switch. Reset switch is a magnetic reed relay that allows alarm sensor to be initialized whenever alarm sensor is first mounted. To install alarm sensor, alarm sensor should be mounted to the outside of unit, on the door or window that provides entry to the unit. With the door or window in the closed position, the installer will force alarm sensor to reset by using an external magnet. After removing the external magnet from alarm sensor, alarm sensor will calibrate for a closed position reading for a period of time.

US 2014/0001779 A1 presents a system for changing a kicking state of a window and/or a door, comprising at least one handle housing that can be connected in a rotationally fixed manner to the window and/or the door and a handle that is rotatably mounted relative to the handle housing. The system further comprises at least one electronic evaluation circuit for detecting the position of the handle, wherein the evaluation circuit is provided with at least one primed circuit board arranged, at least in part, inside the handle housing and/or the handle, and accommodating a first sensor. It is possible for a calibration mode to be initiated by moving the handle in a predetermined manner back and forth between different positions, particularly locking positions, for example two times between the locking and unlocking position. In doing so, both the 180° movement and the locking events upon engagement in the locking and unlocking position as well as the movements through the partial unlocking position are detected via the sensor. Once this calibration mode has been switched on, the individual locking positions of the handle can then be initiated in a predetermined manner and, at the same time, the different positions of the door or window can be set, particularly a completely open position, a completely closed position and a tilted position and combinations of the positions of the handle and window, with a provision being made in particular that, upon reaching the respective window position, the handle is moved in turn in a predetermined manner between various locking positions in order to inform the system that the respective position of the window or door has been reached.

However, the presented calibration requires the system to be set in a calibration mode. This can be performed on installation, but there is a significant risk that calibration does not occur sufficiently often after that, since the calibration requires specific calibration actions from the user, whereby the signals from the sensor can drift from the calibration.

SUMMARY

It would be of great benefit if the way that a position sensor of a barrier position could is calibrated is simplified compared to the prior art.

According to a first aspect, it is presented a method for detecting a position of a barrier. The method is performed in a status monitor device and comprising the steps of: detecting a barrier position of the barrier using a first sensor, the barrier position indicating a degree of opening of the barrier; detecting when the barrier is in a closed position using a second sensor; and calibrating the first sensor to indicate a closed position every time the barrier is detected to be in the closed position. By performing the calibration every time the barrier is detected to be in the closed position, no specific calibration mode is required. The calibration is performed during regular use, without the user explicitly indicating that a calibration is to be performed. This alleviates the user from remembering to calibrate the sensors if positioning becomes unreliable. In fact, since the calibration occurs every time the barrier is closed, drifting of sensor readings compared to calibration is extremely unlikely to occur, thereby increasing reliability of the position sensing.

In the step of detecting a barrier position, the first sensor may be based on an accelerometer being fixed to the barrier.

In the step of detecting a barrier position, the first sensor may be based on measuring times of wireless signal propagation from a transmitter being mounted to the barrier.

In the step of detecting when the barrier is in a closed position, the second sensor may be based on a proximity sensor. In one embodiment, the second sensor is a proximity sensor.

In the step of detecting when the barrier is in a closed position, the second sensor may be based on a barrier lock sensor. In one embodiment, the second sensor is a barrier lock sensor.

The method may further comprise the step of: performing an action based on the barrier position.

The method may further comprise the step of: detecting a current weather condition. In such a case, the step of performing an action comprises presenting a warning alert when the current weather condition indicates bad weather and the barrier position indicates the barrier to be open.

According to a second aspect, it is presented a status monitor device for detecting a position of a barrier. The status monitor device comprises: a processor; and a memory storing instructions that, when executed by the processor, cause the status monitor device to: detect a barrier position of the barrier using a first sensor, the barrier position indicating a degree of opening of the barrier; detect when the barrier is in a closed position using a second sensor; and calibrate the first sensor to indicate a closed position every time the barrier is detected to be in the closed position.

The first sensor may be based on an accelerometer being fixed to the barrier.

The first sensor may be based on measuring times of wireless signal propagation from a transmitter being mounted to the barrier.

The second sensor may be based on a proximity sensor.

According to a third aspect, it is presented a computer program for detecting a position of a barrier. The computer program comprises computer program code which, when run on a status monitor device causes the status monitor device to: detect a barrier position of the barrier using a first sensor, the barrier position indicating a degree of opening of the barrier; detect when the barrier is in a closed position using a second sensor; and calibrate the first sensor to indicate a closed position every time the barrier is detected to be in the closed position.

According to a fourth aspect, it is presented a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1A:
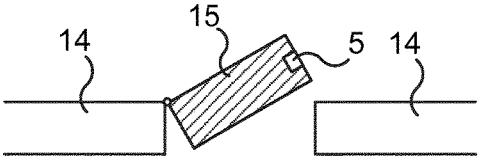
FIGS. 1A-B are schematic diagrams illustrating different positions of a barrier.
Figure 1B:
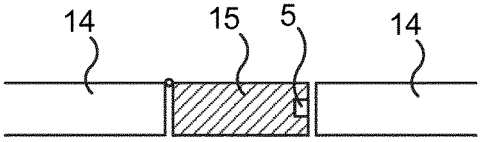

FIGS. 1A-B are schematic diagrams illustrating different positions of a barrier 15. The barrier 15 can be a window, door, gate, hatch, drawer, garage door, loading dock door, etc. Optionally, the barrier 15 is lockable. The barrier 15 is openable and can be in an open state, as shown in FIG. 1A, or a closed state, as shown in FIG. 1B. There is a surrounding structure 14 on either side of the barrier 15. The surrounding structure 14 can e.g. be a wall, fence, ceiling, floor, etc. The opening and closing of the barrier 15 can be implemented using a side hinge such as shown here. However, any other way of implementing a mechanism for opening the barrier can be used, e.g. a top (or bottom) hinge for tilt opening, a jalousie, rolling door (e.g. for garage), sliding mechanism, sash mechanism (e.g. sash window), etc.

The barrier 15 can be open to varying degrees. A first sensor 5 is a position sensor configured to detect the barrier position, where barrier position indicates a degree of opening of the barrier 15. For instance, the barrier position can indicate closed, fully open, open 90 degrees, open 15 degrees, etc. Alternatively, the degree of openness of the barrier can be expressed as a percentage of fully open, so that closed results in 0, fully open results in 100 and other degrees of openness result in a number between 0 and 100. Other scales can equally well be used as long as the barrier position is not a simple state indicator reflecting only open, closed and/or in between open and closed.

However, position sensors can be unreliable and their calibration can drift over time. Embodiments presented herein are based on the realisation that the position sensor (first sensor 5) can be calibrated every time the barrier is closed. In this way, regular calibration of the first sensor prevents accumulative errors in position detection to build up and render the position data unreliable.

Figure 2A:
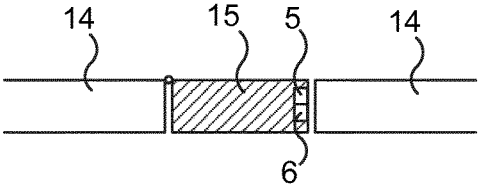
FIGS. 2A-C are schematic diagrams illustrating embodiments of sensors for detecting when the barrier is closed.
Figure 2B:
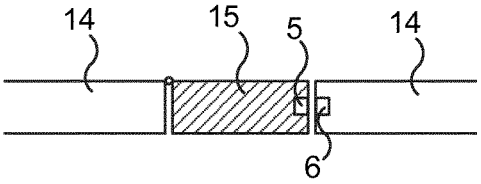
Figure 2C:
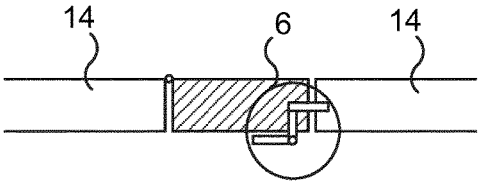

FIGS. 2A-C are schematic diagrams illustrating embodiments of sensors for detecting when the barrier is closed. A second sensor 6 is used to detect when the barrier is closed.

In FIGS. 2A-B, the second sensor is based on a proximity sensor. The proximity sensor can be based on any one or more of electrical capacity, electrical inductivity, infrared light, magnetism (e.g. a Hall sensor), photocell, sonar, mechanical switch etc. In FIG. 2A, the second sensor 6 is a proximity sensor mounted in the barrier 15. The proximity sensor detects when there is an adjacent surrounding structure 14, e.g. as shown in FIG. 2A, to thereby detect when the barrier 15 is closed. Optionally, the surrounding structure 14 is provided with a suitable material (such as metal and/or magnetic material) to improve detectability by the proximity sensor.

In FIG. 2B, the second sensor 6 is a proximity sensor mounted in the surrounding structure 14. The proximity sensor detects when there is an adjacent barrier 15, e.g. as shown in FIG. 2A, to thereby detect when the barrier 15 is closed. Optionally, the barrier 15 is provided with a suitable material (such as metal and/or magnetic material) to improve detectability by the proximity sensor.

In FIG. 2C, the second sensor 6 is based on a barrier lock sensor. The barrier lock sensor can detect when the barrier is mechanically closed e.g. using a handle, lock or similar. For instance, the barrier lock sensor can detect when a bolt is moved into position from the barrier 15 to the surrounding structure 14 or vice versa. The barrier lock sensor can be provided in the barrier or in the surrounding structure 14.

Optionally, the second sensor 6 can also be implemented using a mechanical sensor, such as a switch, which is activated when the barrier is in the closed position.

Figure 3A:
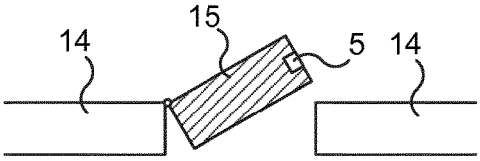
FIGS. 3A-B are schematic diagrams illustrating embodiments of sensors for detecting the position of the barrier.
Figure 3B:
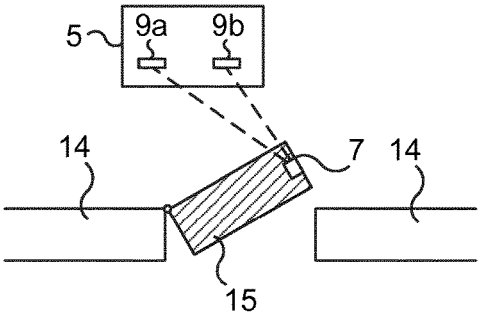

FIGS. 3A-B are schematic diagrams illustrating embodiments of sensors for detecting the position of the barrier.

In FIG. 3A, the first sensor 5 is based on an accelerometer and/or gyro being fixed to the barrier 15. The acceleration values are double integrated to achieve a position value. Due to the double integration, limited numerical capacity and/or noise, errors do occur and can grow quite significant over time. However, due to the calibration every time the barrier is closed as presented herein, this problem is significantly reduced or even practically eliminated.

In one embodiment, the accelerometer is integrated in (or fixed to) a handle of the barrier. In this way, the first sensor can also detect when the user operates the handle. This also enables detection of a position and/or movement of the handle (e.g. when the handle is turned). This can e.g. enable detection of when the handle can be turned to fix the barrier in a certain position, even if it is not in a closed position, such as in a ventilation position. In this way, it is detectable when the barrier is in such a position which is relatively safe, where the risk is low e.g. of a wind slamming the barrier open or closed.

In one embodiment, the accelerometer is an accelerometer in three dimensions. In this way, when applied for a tilt/hinge window which can open in two ways (vertical and horizontal), the accelerometer can detect in which way the window is opened.

In FIG. 3B, the first sensor 5 is based on measuring times of wireless signal propagation from a transmitter 7 being mounted to the barrier. The first sensor 5 comprises one or more antennas 9*a-b*. By measuring the time the wireless signal from the transmitter 7 takes to arrive (time of arrival, ToA) at the one or more antennas 9*a-b*, the position of the transmitter 7, and thus the barrier 15, can be derived. When the transmitter 7 can only travel along a single given path during normal operation, e.g. by pivoting as shown in FIG. 3B, it may be sufficient with one antenna in the first sensor 5. When the barrier 15 can open so that the transmitter 17 of the barrier 15 can move along multiple paths, the first sensor 5 should contain at least two antennas to allow positioning in a two-dimensional coordinate system.

For instance, angle of arrival (AoA) can be used to determine position. When a wireless signal is received by the first sensor 5 from the transmitter 7, a time difference in receiving the wireless signal by the two antennas 9*a-b* can be detected. This can e.g. be detected using a phase difference between the received signals. Using the time difference, the AoA from the pair of antennas is calculated. If the first sensor 5 contains a third antenna, the AoA from a second pair of antennas (one antenna can be common with the other pair) can be calculated. In this way, the position can be determined as the location satisfying both AoA calculations.

Alternatively or additionally, ToA can be employed to detect a distance from each one of the two antennas 9*a-b*. The position of the transmitter 7 can then be derived to be a point satisfying the distances to both antennas 9*a-b*. Typically, when there are two possible points, one point can be discarded due to not being within the normal operating area of the transmitter 7.

Figure 4:
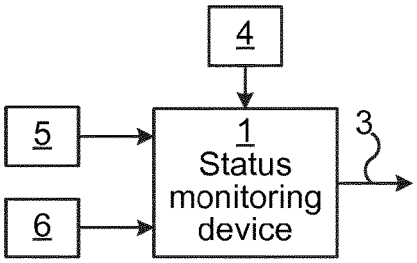
FIG. 4 is a schematic diagram illustrating the environment of a status monitoring device which can be applied in any of the embodiments illustrated in FIGS. 1A-B, FIGS. 2A-C and FIGS. 3A-B.

FIG. 4 is a schematic diagram illustrating the environment of a status monitoring device which can be applied in any of the embodiments illustrated in FIGS. 1A-B, FIGS. 2A-C and FIGS. 3A-B.

The status monitoring device 1 is connected to the first sensor 5 and the second sensor 6 for one or more barriers. As explained above, the first sensor 5 provides position data and the second sensor 6 provides data indicating when the barrier is closed.

The status monitoring device 1 provides output data 3 e.g. to inform other systems (e.g. alarm system, HVAC (Heating Ventilation Air Conditioning), etc.) of the status of the barriers based on the provided barrier positions or the position data of the barriers. For instance, the alarm system or the HVAC system can be informed of any open doors or windows to adjust ventilation and/or heating/cooling. The barrier position data can be used for energy efficiency purposes, informing when the door/window is open and how much, enabling calculating energy efficiency based on this information.

Optionally, also the speed of opening/closing is detected and informed. For instance, this can be used to alert users of when windows and doors are slammed to a degree that it risks damaging the window or door.

Optionally, one or more weather sensors 4 are provided to provide weather data to the status monitoring device 1. The weather sensor 4 can e.g. detect wind, rain, temperature, humidity, etc. This allows the status monitoring device 1 to detect bad weather (e.g. using thresholds of any one or more of wind, rain, temperature and humidity) and combine this with barrier position data, e.g. to present a warning alert as output data 3 there is bad weather and the barrier position indicates the barrier to be open. Optionally, the warning alert is not presented if the window in only open a small amount, such as in a specific fresh air position.

Figure 5:
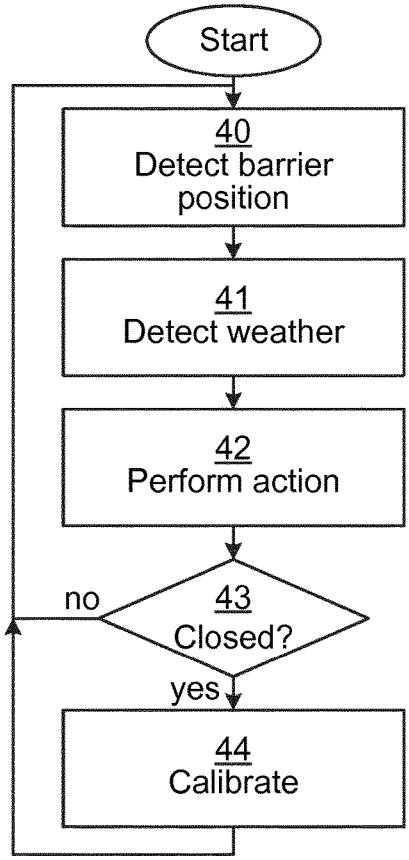
FIG. 5 is a flow chart illustrating embodiments of a method performed in the status monitoring device for detecting a position of the barrier.

FIG. 5 is a flow chart illustrating embodiments of a method performed in the status monitoring device for detecting a position of the barrier.

In a detect barrier position step 40, a barrier position of the barrier is detected using a first sensor. The barrier position indicates a degree of opening of the barrier, e.g. closed, open 15 degrees, open 90 degrees, etc. As explained above with reference to FIG. 3A, the first sensor can be based on an accelerometer being fixed to the barrier. Alternatively or additionally, as explained above with reference to FIG. 3B, the first sensor can be based on measuring times of wireless signal propagation from a transmitter being mounted to the barrier. Alternatively or additionally, the first sensor can be based on a magnetometer.

In an optional detect weather step 41, a current weather condition, e.g. using the weather sensor 4 of FIG. 4 and described above. The weather condition can e.g. be based on detection of wind, rain, temperature, humidity, etc.

In an optional perform action step 42, an action is performed based on the barrier position. In one embodiment, when the detect weather step 41 has been executed, this comprises presenting a warning alert when the current weather condition indicates bad weather and the barrier position indicates the barrier to be open. Bad weather can e.g. be defined when respective thresholds of any one or more of wind, rain, temperature and humidity are exceeded. Optionally, open can here be defined as open more than a threshold amount.

Other example of performing action can be to inform other systems (e.g. alarm system, HVAC, etc.) of the status of the barriers based on the provided barrier positions. For instance, the alarm system or the HVAC system can be informed of any open doors or windows to adjust ventilation and/or heating/cooling. The barrier position data can be used for energy efficiency purposes, informing when the door/window is open and/or using this information to calculate energy efficiency.

In a conditional closed step 43, it is determined when the barrier is in a closed position using a second sensor. As explained above with reference to FIGS. 2A-B, the second sensor can be based on a proximity sensor. Alternatively or additionally, as explained above with reference to FIG. 2C, the second sensor can be based on a barrier lock sensor. If it is determined that the barrier is closed, the method proceeds to a calibrate step. Otherwise, the method returns to the detect barrier position step 40.

In the calibrate step 44, the first sensor is calibrated to indicate a closed position. This step is performed every time the first sensor indicates a closed position, to thereby ensure proper calibration as often as possible. This prevents drifting of sensor values compared to previous calibration. Optionally, if the first sensor is in a handle, two dimensions can be calibrated here when, in step 43, it is determined that the barrier is closed. Additionally, when, in step 43, it is determined that the barrier is also locked, a third dimension of the first sensor can be calibrated in step 44. When the barrier is locked, this indicates that the handle is turned to a (known) locked position. The determination of whether the barrier is locked can e.g. be based on the second sensor being capable of detecting when a bolt is in an extended position.

Using this method, the eventual unreliability of position sensors is no longer a problem. Since the position sensor (first sensor 5) is calibrated every time the barrier is closed using the second sensor 6, no special user involvement is required to perform the calibration. In this way, regular calibration is achieved automatically and accumulative errors in position detection is prevented from building up and rendering the position data unreliable.

Figure 6:
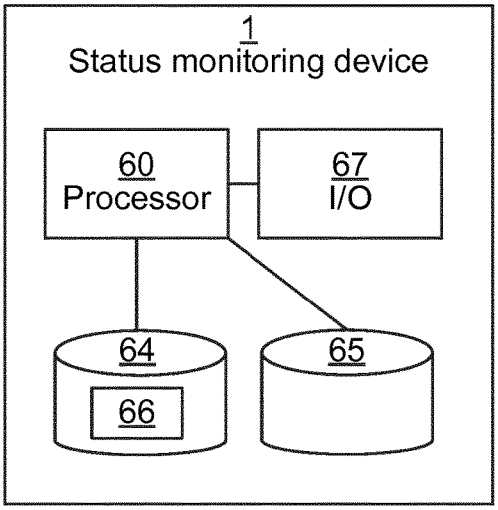
FIG. 6 is a schematic diagram showing some components of the status monitoring device of FIG. 4.

FIG. 6 is a schematic diagram showing some components of the status monitoring device 1 of FIG. 4. A processor 60 is provided using any combination of one or more of a suitable central processing unit (CPU), multiprocessor, microcontroller, digital signal processor (DSP), application specific integrated circuit etc., capable of executing software instructions 66 stored in a memory 64, which can thus be a computer program product. The processor 60 can be configured to execute the method described with reference to FIG. 4 above.

The memory 64 can be any combination of read and write memory (RAM) and read only memory (ROM). The memory 64 also comprises persistent storage, which, for example, can be any single one or combination of magnetic memory, optical memory, solid state memory or even remotely mounted memory.

A data memory 65 is also provided for reading and/or storing data during execution of software instructions in the processor 60. The data memory 65 can be any combination of read and write memory (RAM) and read only memory (ROM).

The status monitoring device 1 further comprises an I/O interface 67 for communicating with other external entities, such as the first sensor 5 and the second sensor 6 and other external systems such as an alarm system and/or an HVAC system. Optionally, the I/O interface 67 also includes a user interface.

Other components of the status monitoring device 1 are omitted in order not to obscure the concepts presented herein.

Figure 7:
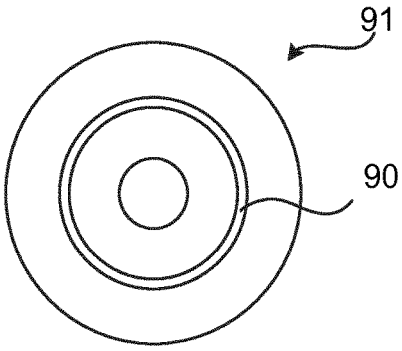
FIG. 7 shows one example of a computer program product comprising computer readable means.

FIG. 7 shows one example of a computer program product comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 6. While the computer program 91 is here schematically shown as a track on the depicted optical disk, the computer program can be stored in any way which is suitable for the computer program product, such as a removable solid state memory, e.g. a Universal Serial Bus (USB) drive.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A method for detecting a position of a barrier, the method being performed in a status monitor device and comprising the steps of:

detecting a barrier position of the barrier using a first sensor, the barrier position indicating a degree of opening of the barrier;

detecting every instance when the barrier is in a closed position using a second sensor; and re-calibrating the first sensor to indicate a closed position in response to each instance the barrier is detected in the closed position.

2. The method according to claim 1, wherein in the step of detecting a barrier position, the first sensor is based on an accelerometer being fixed to the barrier.

3. The method according to claim 1, wherein in the step of detecting a barrier position, the first sensor is based on measuring times of wireless signal propagation from a transmitter being mounted to the barrier.

4. The method according to claim 1, wherein in the step of detecting when the barrier is in a closed position, the second sensor is based on a proximity sensor.

5. The method according to claim 1, wherein in the step of detecting when the barrier is in a closed position, the second sensor is based on a barrier lock sensor.

6. The method according to claim 1, further comprising the step of:

performing an action based on the barrier position.

7. The method according to claim 6, further comprising the step of:

detecting a current weather condition; and wherein the step of performing an action comprises presenting a warning alert when the current weather condition indicates bad weather and the barrier position indicates the barrier to be open.

8. A status monitor device for detecting a position of a barrier, the status monitor device comprising:

a processor; and a memory storing instructions that, when executed by the processor, cause the status monitor device to:

detect a barrier position of the barrier using a first sensor, the barrier position indicating a degree of opening of the barrier;

detect when the barrier is in a closed position using a second sensor; and in response to each instance of the second sensor detecting the barrier as being in the closed position, automatically re-calibrating the first sensor to indicate the closed position.

9. The status monitor device according to claim 8, wherein the first sensor is based on an accelerometer being fixed to the barrier.

10. The status monitor device according to claim 8, wherein the first sensor is based on measuring times of wireless signal propagation from a transmitter being mounted to the barrier.

11. The status monitor device according to claim 8, wherein the second sensor is based on a proximity sensor.

12. A computer program for detecting a position of a barrier, the computer program comprising computer program code which, when run on a status monitor device causes the status monitor device to:

detect a barrier position of the barrier using a first sensor, the barrier position indicating a degree of opening of the barrier;

detect when the barrier is in a closed position using a second sensor; and automatically re-calibrate the first sensor to indicate a closed position for each instance the barrier is detected to be in the closed position by the second sensor.

13. A computer program product comprising a computer program according to claim 12 and a computer readable means on which the computer program is stored.

* * * * *